US005520039A

United States Patent [19]

Albert

[11] Patent Number: 5,520,039

[45] Date of Patent: May 28, 1996

[54] STRAIGHTENING APPARATUS FOR WIRE, CABLE AND TUBULAR MATERIAL

[75] Inventor: Eckehard Albert, Berlin, Germany

[73] Assignee: Witels Apparate-Maschinen Albert GmbH & Co KG, Berlin, Germany

[21] Appl. No.: 222,847

[22] Filed: Apr. 5, 1994

[30] Foreign Application Priority Data

Apr. 6, 1993 [DE] Germany ..... 43 11 300.1

[51] Int. Cl.[6] ..... B21D 3/02

[52] U.S. Cl. ..... 72/164; 72/237; 277/57

[58] Field of Search ..... 72/164, 165, 162, 72/160, 237, 238; 277/57, 56, 53; 384/480

[56] References Cited

U.S. PATENT DOCUMENTS

| | | | |
|---|---|---|---|
| 1,105,268 | 7/1914 | Gohlke | 277/56 |
| 1,716,362 | 6/1929 | Billigmann | 72/238 |
| 2,123,754 | 7/1938 | Talbot | 72/237 |
| 2,870,818 | 1/1959 | Herr | 72/164 |
| 2,920,678 | 1/1960 | Cunningham | 72/164 |
| 3,273,369 | 9/1966 | Modder | 72/164 |
| 4,022,046 | 5/1977 | Serizawa | 72/164 |
| 4,379,600 | 4/1983 | Muller | 277/56 |
| 4,527,915 | 7/1985 | Ikariishi | 384/480 |

FOREIGN PATENT DOCUMENTS

| | | | |
|---|---|---|---|
| 431331 | 7/1926 | Germany | 72/164 |
| 1249799 | 9/1967 | Germany | 72/237 |
| 579044 | 11/1977 | U.S.S.R. | 72/237 |
| 1409361 | 7/1988 | U.S.S.R. | 72/237 |
| 595071 | 11/1947 | United Kingdom | 72/160 |
| 873332 | 7/1961 | United Kingdom | 72/165 |

*Primary Examiner*—Daniel C. Crane
*Attorney, Agent, or Firm*—Collard & Roe

[57] ABSTRACT

A straightening apparatus with a plurality of rotatable straightening rollers arranged in two parallel planes. The axles of the rollers are supported in cassettes arranged in a housing holder, whereby one of the cassettes or the cassettes of one plane or also of both planes are adjustably arranged by means of an adjusting device. Each cassette has a housing in the form of a hollow cylinder and is exchangeably arranged in fitted bores. Preferably, the axial forces transmitted from the straightening roller to the axle are absorbed by a ball bearing, and the radial forces by a pin bearing. The ball raceway for the ball bearing is made directly in the hollow cylindrical housing and axle, and the pin bearing is arranged directly between the housing and the axle.

3 Claims, 1 Drawing Sheet

STRAIGHTENING APPARATUS FOR WIRE, CABLE AND TUBULAR MATERIAL

BACKGROUND OF THE INVENTION

1. Field of the Invention

The present invention relates to straightening apparatuses. More particularly, it relates to a straightening apparatus for wire cable or tubular material having a straightening rollers supported in removable cassettes.

2. The Prior Art

A straightening apparatus with cassettes adjustable in one plane is known from German patent DE 32 26 665 C2.

With the prior art apparatus, the cassettes have a rectangular shape and grooves. The grooves are engaged by pins on which the cassettes are guided in a straight line. At each end, the pins rest in grooves in both the top and bottom cover plates of a multipart housing holder. This configuration makes it possible to brace the cassettes against each other. The cassettes of one plane are arranged such that they support themselves, in each case, against a spring, which presses the cassette against a set screw. By screwing the set screw in or out, the cassette and its respective straightening roller, can be adjusted against or away from the material to be straightened.

Such an arrangement of the cassettes is relatively complicated and requires an extensive expenditure of time and labor. It also requires a certain play in the cassettes in addition to distortions, thereby requiring a new adjustment of the cassettes each time a change of the straightening rollers is needed. For example, when the straightening rollers are replaced due to wear, or when the roller size is changed for working other materials, new adjustments in the cassettes are needed.

SUMMARY OF THE INVENTION

The present invention provides a straightening apparatus having a plurality of rotatable straightening rollers arranged in two parallel planes. The axles of the rollers are supported in cassettes, which are arranged in a housing holder. The cassettes are comprised of a hollow cylindrical housing and are disposed in fitted bores in the straightening apparatus. The cassettes of both planes can be immovable, or the cassettes of one plane or also both planes can be arranged to be adjustable by means of an adjusting device.

It is therefore an object of the present invention to provide a straightening apparatus such that the cassettes can be exchanged without an extensive expenditure of time and labor.

It is another object of the invention to provide a straightening apparatus that offers high precision during straightening and an extended service life.

It is yet another object of the invention to provide a straightening apparatus that minimizes the required play in the cassettes and provides a precise and easily reproducible adjustment thereof.

BRIEF DESCRIPTION OF THE DRAWINGS

Other objects and features of the present invention will become apparent from the following detailed description considered in connection with the accompanying drawing. It should be understood, however, that the drawing is designed for the purpose of illustration only and not as a definition of the limits of the invention.

In the drawing, wherein similar reference characters denote similar elements throughout the several views.

DETAILED DESCRIPTION OF PREFERRED EMBODIMENTS

Figure 1:
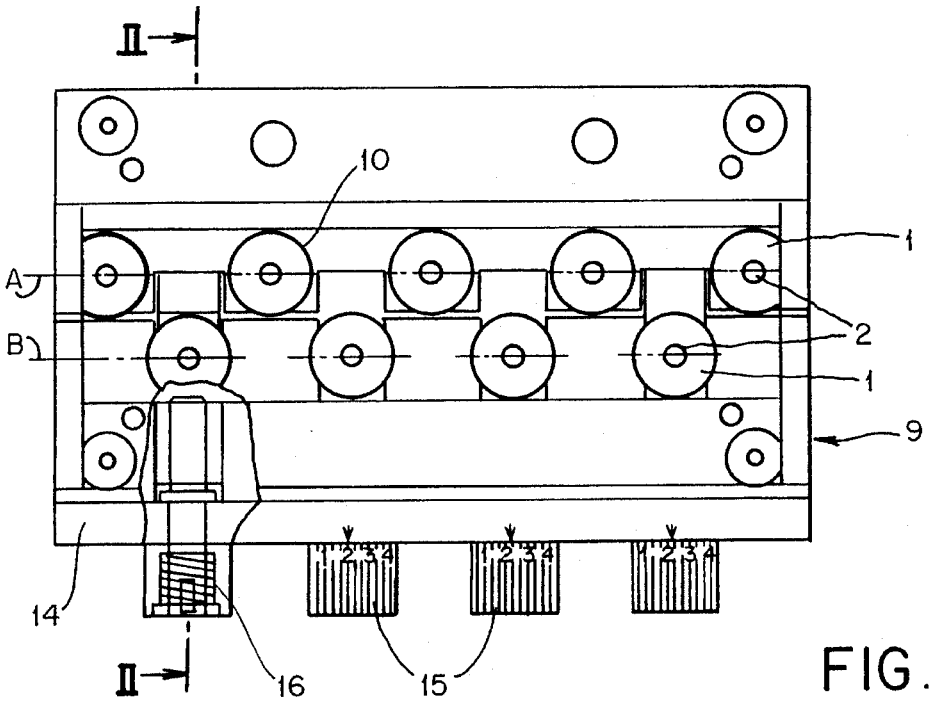
FIG. 1 is a top view of the straightening apparatus of the invention with partial cutout.
Figure 3:
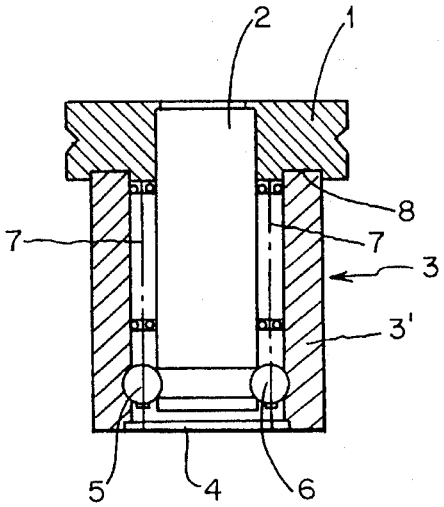

Referring to FIG. 1, the straightening rollers 1 are arranged in the two parallel planes A and B. The axles 2 of rollers 1 are rotatably supported in cassettes 3 (FIG. 3).

The cassettes 3 consist of a hollow cylindrical housing 3' which is closed on one side by a cover 4 and open on the other opposite side. The housing 3' has the rotary axle 2, supporting the straightening roller 1, inserted in its open end. For axial support, axle 2 is supported by means of a ball bearing 5 at the closed end of the cassette 3. The raceway for balls 6 is arranged in the hollow cylindrical housing 3' on the one side, and in rotary axle 2 on the other side. For the radial support of axle 2, pin bearings 7 are arranged in the upper part of hollow cylindrical housing 3' directly between the inside wall of said housing and rotary axle 2.

Straightening roller 1 has an annular groove 8 (FIG. 3), which is intended to receive the upper open end of hollow cylindrical housing 3'. Through this arrangement, a labyrinth seal is produced that permits using a straightening apparatus with such cassettes also in moist and dusty rooms. The labyrinth seal prevents foreign objects from entering the cassette without interfering with the axial or radial movement of the straightening roller. Thus, the bearings of the rotary axle are protected from dirt, which increases their useful life. The play in straightening roller 1 is minimized by the direct arrangement of the axial ball bearing 5 and the radial pin bearings 7 in relation to rotary axle 2, i.e., without outer and inner rings.

Cover 4 of cassette 3 can be embodied also as one piece with hollow cylindrical housing 3'. The connection of straightening roller 1 with its rotary axle 2 can be made in any desired way. For example, by gluing roller 1 to rotary axle 2, it's possible to remove the straightening rollers 1 from rotary axle 2 in order to replace the rollers with new ones, or with rollers having different diameters and/or punctures. Thus, the replacement will not require a significant expenditure of time and labor, and thereby increase productivity. It is not necessary, but it is possible to exchange the entire cassette 3.

Figure 2:
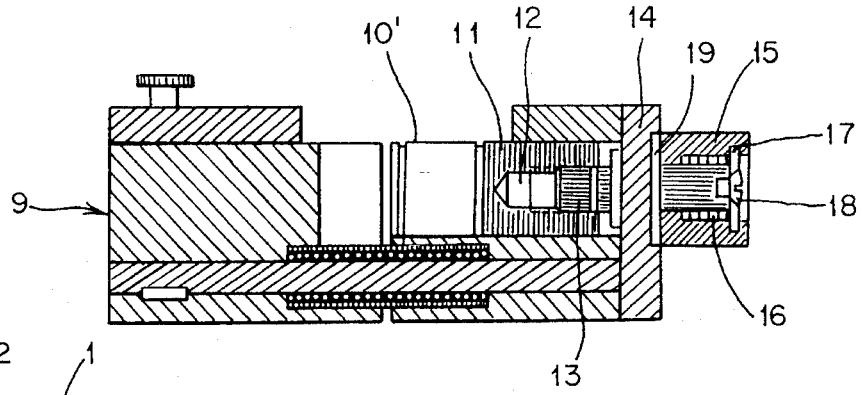
FIG. 2 is a cross-sectional view of the straightening apparatus of the invention taken along line II—II in FIG. 1; and, FIG. 3 is a cross-sectional view of a cassette of the invention.

Cassettes 3 are arranged in plane A in a housing holder 9 having fitted bores 10 provided therein. The diameter of the bores are selected such that hollow cylindrical housing 3' of cassettes 3 can be just inserted without play. Fitted bores 10 can be produced exactly and simply, thereby providing a highly precise arrangement of cassettes 3, particularly with each subsequent exchange. In the preferred embodiment, cassettes 3 are arranged in plane B in fitted bores 10' (FIG. 2), said bores being created by a guided, movable slot stone 11. Slot stone 11 has a threaded bore 12 which is engaged by an adjusting spindle 13. The free end of adjusting spindle 13 extends through a wall 14 of housing holder 9 and supports an adjusting button 15. Adjusting button 15 is axially movable on adjusting spindle 13, but mounted with torsional rigidity. Within adjusting button 15, a spiral spring 16 is arranged on adjusting spindle 13. Spring 16 supports itself at one end against a projection of adjusting button 15, and at the other end against a disk 17. Disk 17 is fixed by a screw 18, both on adjusting button 15 and adjusting spindle 13. With this arrangement of spiral spring 16, adjusting button 15 is prestressed against wall 14 of housing holder 9.

Wall 14 has, within the zone of the joined surface of adjusting button 15, a recess in which a rubber disk 19 is disposed. Rubber disk 19, in addition to the contact pressure by spiral spring 16, increases the friction between adjusting button 15 and wall 14 such that adjusting button 15 cannot independently adjust itself, even in the presence of strong vibrations during the course of operation. Instead of a recess, a friction-increasing material, for example, a plastic material, leather or the like can be applied directly to adjusting button 15 and/or directly to wall 14. Instead of using a different material, it is also possible to make other provisions for increasing the friction between the wall and the button, for example, locking connections (not shown). In considering the possibility of axial movement of the adjusting button 15 against the pressure of spiral spring 16, the frictional connection can be released, thereby allowing an easy, and therefore highly precise, adjustment of adjusting spindle 13 and slot stone 11. If no exact adjustment is required, the axial adjustment of the adjusting button 15 can be omitted. In this case, it is only necessary to expend greater force for the adjustment of adjusting button 15 in order to overcome the frictional connection.

Through any known axial guidance of slot stone 11 and corresponding selection of the pitch of the thread, it is possible to insure a highly precise and readily readjustable position of cassettes 3 and thus of straightening rollers 1 of plane B.

In case of applications under extreme stress and for prolonging the useful life, the bearings of rotary axle 2 can be periodically supplied with a lubricant, for example by way of a sealable bore system (not shown) in rotary axle 2 when the straightening apparatus is shut down. It is also possible to make provisions within the wall of hollow cylindrical housing 3' for a lubricant depot with outlet openings leading to bearings 5 and 7 which, if need be, may be connected also to a feed line system within housing holder 9 (both options not shown).

While several embodiments of the present invention have been shown and described, it is to be understood that many changes and modifications may be made thereunto without departing from the spirit and scope of the invention as defined in the appended claims.

What is claimed is:

1. A straightening apparatus for wire, cable and tubular material comprising:

a main housing with an outer surface and a plurality of fitted bores formed within said main housing;

a plurality of cassettes, each cassette being removably disposed within one of said plurality of fitted bores and comprising a hollow cylindrical housing with a top edge;

a plurality of axles, each axle being rotatably mounted within one of said plurality of cassettes and having a free end extending outwardly of the respective cassette;

a plurality of straightening rollers, each straightening roller being removably mounted on one of said free ends, said plurality of cassettes being arranged in two adjacent parallel rows; and a plurality of labyrinth seals, each labyrinth seal being formed between one of said straightening rollers and the respective cassette;

a plurality of adjusting devices, each adjusting device adjusting the position of one of said cassettes in one of said rows, each adjusting device comprising a slot stone, an adjusting spindle, a spring, a friction-increasing element and an adjusting dial; and each adjusting dial is axially diplaceable along said corresponding adjusting spindle, wherein each spring biases said corresponding adjusting dial against said outer surface with said corresponding friction-increasing element sandwiched therebetween to avoid inadvertent adjustment of said corresponding adjustment dial.

2. The straightening apparatus according to claim 1, wherein each labyrinth seal comprises:

an annular groove formed within the corresponding straightening roller for receiving said top edge of the corresponding cassette.

3. The straightening apparatus according to claim 1, further comprising;

a plurality of ball raceways, each ball raceway is formed directly within each hollow cylindrical housing and each axle;

a plurality of ball bearings, each ball bearing is disposed within each ball raceway for absorbing axial forces on said corresponding axle transmitted from said corresponding straightening roller; and a plurality of pin bearings, each pin bearing is located directly between each hollow cylindrical housing and the corresponding axle for absorbing radial forces on said corresponding axle transmitted from said corresponding straightening roller.

* * * * *